US007333910B2

(12) United States Patent
Ishii

(10) Patent No.: US 7,333,910 B2
(45) Date of Patent: Feb. 19, 2008

(54) FIRE SENSING METHOD AND FIRE SENSING SYSTEM USING WIRELESS CHIP FOR SENSING FIRE

(75) Inventor: Masato Ishii, Isehara (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 11/405,516

(22) Filed: Apr. 18, 2006

(65) Prior Publication Data

US 2006/0238312 A1 Oct. 26, 2006

(30) Foreign Application Priority Data

Apr. 26, 2005 (JP) ..... 2005-128743

(51) Int. Cl.
*G08B 17/00* (2006.01)

(52) U.S. Cl. ..... 702/130; 702/136; 702/150; 340/286.05

(58) Field of Classification Search ..... 702/130, 702/136
See application file for complete search history.

(56) References Cited

U.S. PATENT DOCUMENTS 6,078,269 A * 6/2000 Markwell et al. ..... 340/517
6,859,831 B1 * 2/2005 Gelvin et al. ..... 709/224
6,960,987 B2 11/2005 Dohi et al. ..... 340/286.05
7,148,797 B2 * 12/2006 Albert ..... 340/521
2002/0075163 A1 * 6/2002 Smith et al. ..... 340/870.16
2003/0058093 A1 3/2003 Dohi et al. ..... 340/506
2003/0067889 A1 * 4/2003 Petite ..... 370/310
2006/0176169 A1 * 8/2006 Doolin et al. ..... 340/521
2006/0181406 A1 * 8/2006 Petite et al. ..... 340/521

FOREIGN PATENT DOCUMENTS

JP 2003-099869 4/2003

* cited by examiner

*Primary Examiner*—Hal Wachsman
(74) *Attorney, Agent, or Firm*—Eric J. Robinson; Robinson Intellectual Property Law Office, P.C.

(57) ABSTRACT

The present invention provides a fire sensing system comprising a step of recording positional data of a wireless chip in a memory included in the wireless chip, a step of obtaining temperature data from a temperature sensor included in the wireless chip to be recorded in the memory, a step of taking out the positional data and the temperature data from the memory, and a step of judging whether a fire occurs or not based on an individual identification number, the positional data, and the temperature data of the wireless chip.

22 Claims, 11 Drawing Sheets

FIRE SENSING METHOD AND FIRE SENSING SYSTEM USING WIRELESS CHIP FOR SENSING FIRE

This application is based on Japanese Patent Application serial No. 2005128743 filed in Japan Patent Office on 26, Apr. 2005, and the entire contents of which are hereby incorporated by reference.

BACKGROUND OF THE INVENTION

1. Field of the Invention

The present invention relates to a fire sensing method and a fire sensing system using a wireless chip for sensing a fire.

2. Description of the Related Art

In recent years, many systems relating to fire sensing have been proposed; however, a majority of the conventional systems relating to fire sensing has required to determine an installation site for a fire sensing device when the building or vehicle has been designed. Moreover, since the fire sensing has been transmitted by a wire, it has also been necessary to determine an installation site for the wire for transmitting, in advance when designing. In particular, as the building or vehicle is increased in size, the number of wires for transmitting is also increased to be provided (see Patent Document 1).

Patent Document 1

Japanese Patent Laid-Open No. 2003-099869

SUMMARY OF THE INVENTION

The conventional fire sensing system has required to determine an installation site for a fire sensing device in advance when designing the building or vehicle. That becomes not only a restriction on design of the building or vehicle but also one cause of increasing the design cost. Further, since the fire sensing has been transmitted by a wire, in addition to the design cost of determining the installation site of the wire for transmitting, the material cost of the wire has also been piled up.

Furthermore, after the fire sensing device has been disposed at a certain site and the building or vehicle has been completed, it has been extremely difficult to change, add, and reduce the installation site for the fire sensing device or the wire for transmitting.

A system of the present invention is a fire sensing system in which a wireless chip attaching to a building or vehicle is used. The wireless chip of the invention incorporates at least a temperature sensor and a memory for recording positional data and temperature data which is obtained by a sensor incorporating a temperature sensing function (called a "temperature sensor" hereinafter), of the wireless chip. The system of the invention further includes a reading and writing apparatus capable of obtaining the data recorded in the memory incorporated in the wireless chip, by sending radio waves, and a data processing unit in which a program for checking the installation position of the wireless chip and the temperature around that, by using data obtained through the reading/writing apparatus is installed. According to such system of the invention, fire occurrence can be judged and informed to an appropriate contact address, using the data processing unit.

A specific structure of the present invention is described hereinafter.

One mode of the invention is a fire sensing method in which positional data of a wireless chip is recorded in a memory included in the wireless chip having a power supply generating circuit, temperature data is obtained from a temperature sensor included in the wireless chip to be recorded in the memory, the positional data and the temperature data are taken out from the memory, and based on an individual identification number, the positional data, and the temperature data of the wireless chip, whether a fire occurs or not is judged.

In addition, another mode of the invention is a fire sensing method in which an individual identification number is recorded and positional data of a wireless chip is recorded in a memory included in the wireless chip having a power supply generating circuit, temperature data is obtained from a temperature sensor included in the wireless chip to be recorded in the memory, the positional data and the temperature data are taken out from the memory, and based on the individual identification number, the positional data, and the temperature data, whether a fire occurs or not is judged.

In addition, another mode of the invention is a fire sensing system in which a wireless chip having a temperature sensor and a power supply generating circuit, a reading and writing apparatus for recording positional data of the wireless chip in a memory included in the wireless chip, a data processing unit connected to the reading and writing apparatus, and a central control data processing unit connected through a communication network are included. Temperature data is recorded in the memory from the temperature sensor included in the wireless chip by the reading and writing apparatus, and based on the positional data, the temperature data, and an individual identification number of the wireless chip from the memory, whether a fire occurs or not is judged by the data processing unit or the central control data processing unit.

In addition, another mode of the invention is a fire sensing system in which a plurality of wireless chips each having a temperature sensor and a power supply generating circuit, a reading and writing apparatus for recording positional data of the wireless chip in a memory included in each wireless chip, a data processing unit connected to the reading and writing apparatus, and a central control data processing unit connected through a communication network are included. Each identification number of the plurality of wireless chips is recognized and temperature data is recorded in the memory from the temperature sensor included in each of the plurality of wireless chips by the reading and writing apparatus, and based on the positional data, the temperature data, and the individual identification number of the wireless chip from the memory, whether a fire occurs or not is judged by the data processing unit or the central control data processing unit.

In the invention, a memory using a structure of a write-once memory can be used as the memory. The write-once memory is a memory having a structure incapable of being rewritten. In addition, the memory can be an active type which includes a memory element and a transistor connected to the memory element, and the memory element and the transistor can be formed over an insulating substrate. The memory element is specifically an element in which a memory material layer is interposed between a pair of electrodes.

According to the fire sensing system using a wireless chip having a temperature sensor of the invention, it is not necessary to determine an installation site for a fire sensing device in advance when a building or vehicle is designed. Consequently, that does not become a restriction on design of the building or vehicle and can achieve the reduction of the design cost. In addition, since the fire sensing is confirmed wirelessly, the cost of installing a wire is not required so that the maintenance cost relating to wire maintenance is not required.

Further, according to the fire sensing system of the invention, after a building or vehicle is completed or at the existing building or vehicle, the fire sensing system using a wireless chip having a temperature sensor can be easily established.

BEST MODE FOR CARRYING OUT THE INVENTION

Figure 1:
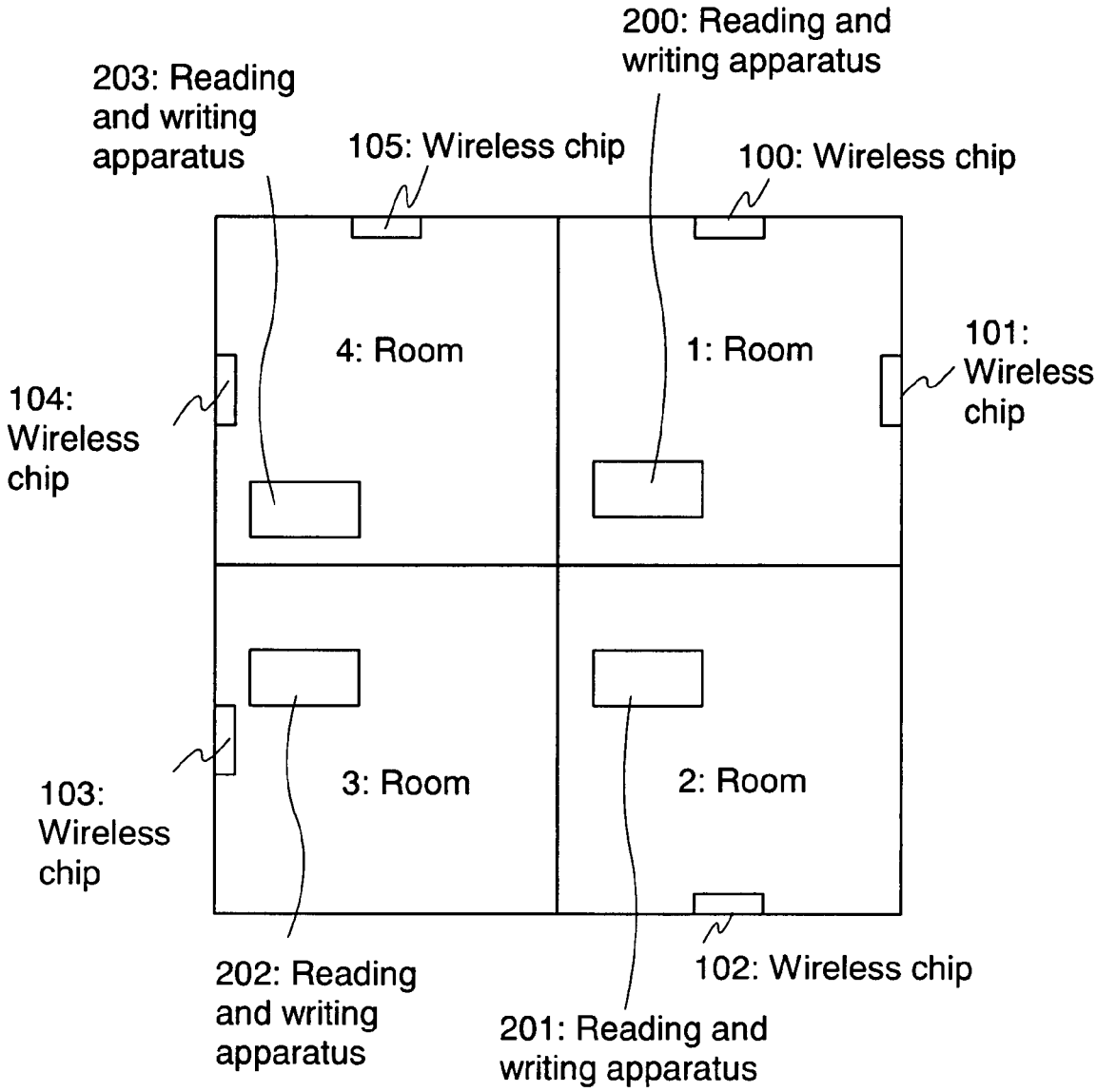
FIG. 1 is a diagram showing a system of the invention.

Although the invention will be fully described by way of embodiment modes with reference to the accompanying drawings, it is to be understood that various changes and modifications will be apparent to those skilled in the art. Therefore, unless such changes and modifications depart from the scope of the invention, they should be construed as being included therein. Note that in the drawings for describing the embodiment modes, identical portions or portions having a similar function in different drawings are denoted by the same reference numeral and repetitive descriptions thereof are omitted.

EMBODIMENT MODE 1

In this embodiment mode, taking as an example a building of which a fire is to be sensed, a system of the invention from occurrence of the fire to communication to an appropriate place is described with reference to the drawings.

FIG. 1 shows four rooms included in a building, namely room layout, and a place for attaching a wireless chip. As shown in FIG. 1, wireless chips 100 to 105 relating to this embodiment mode can be attached to a ceiling, a wall, a flooring, an outside wall, or the like of the building. The wireless chip which is very thin and light-weight can be attached even to a ceiling or the like by providing adhesiveness for a rear surface thereof. In order to provide adherence, an adhesive layer such as an acrylic adhesive layer, an epoxy adhesive layer, or an olefin adhesive layer is provided on the rear surface of the wireless chip. The arbitrary number of such wireless chips can be attached to an arbitrary place of the building. In addition, the wireless chip of the invention can be attached at an arbitrary opportunity such as during construction of the building or after construction of the building. Further, the wireless chips 100 to 105 which are protected by an insulating film having high heat-resistance can hold their states to some extent even after the fire occurrence. As the insulating film having high heat-resistance, there is an organic resin such as polyimide. In addition, a cover provided with an opening capable of passing heat or gas may also be provided so as to cover the attached wireless chip. The cover is formed of a high heat-resistant material. According to the above-described mode, change of the temperature or the like just after the fire occurrence can be grasped, and besides, the state of the wireless chip can be held until a predetermined time after the fire occurrence.

Each of the wireless chips 100 to 105 incorporates a memory and in a part of the memory, an individual identification number of the wireless chip is recorded. The individual identification number of the wireless chip is preferably recorded at the manufacturing step of the wireless chip. Such data recorded at the manufacturing step can be provided by a mask ROM (Read Only Memory) or the like.

In rooms 1 to 4, reading and writing apparatuses 200 to 203 are installed respectively. Each of the reading and writing apparatuses 200 to 203 is installed at a place from which radio waves can be reached to a wireless chip entirely within a setting range. For example, the respective reading and writing apparatuses 200 to 203 are installed in the rooms 1 to 4. Note that each of the reading and writing apparatuses 200 to 203 is not necessarily installed in each room, and there is such an installation method that one reading and writing apparatus is installed for a plurality of rooms, for each floor, for each building, or the like as long as within the range capable of reaching radio waves to a wireless chip. These reading and writing apparatuses 200 to 203 can send radio waves in order to produce a power source, execute an instruction, or the like by the wireless chips 100 to 105.

Each of the wireless chips 100 to 105 receives the radio waves from the reading and writing apparatus through an antenna, and includes a circuit capable of generating a power source when the radio waves are received, to operate a circuit within the wireless chip. Further included is a circuit capable of generating a clock from the received radio waves, to synchronously operate the circuit within the wireless chip. Further, a circuit capable of extracting an instruction from the received radio waves and executing the instruction is included.

Figure 2:
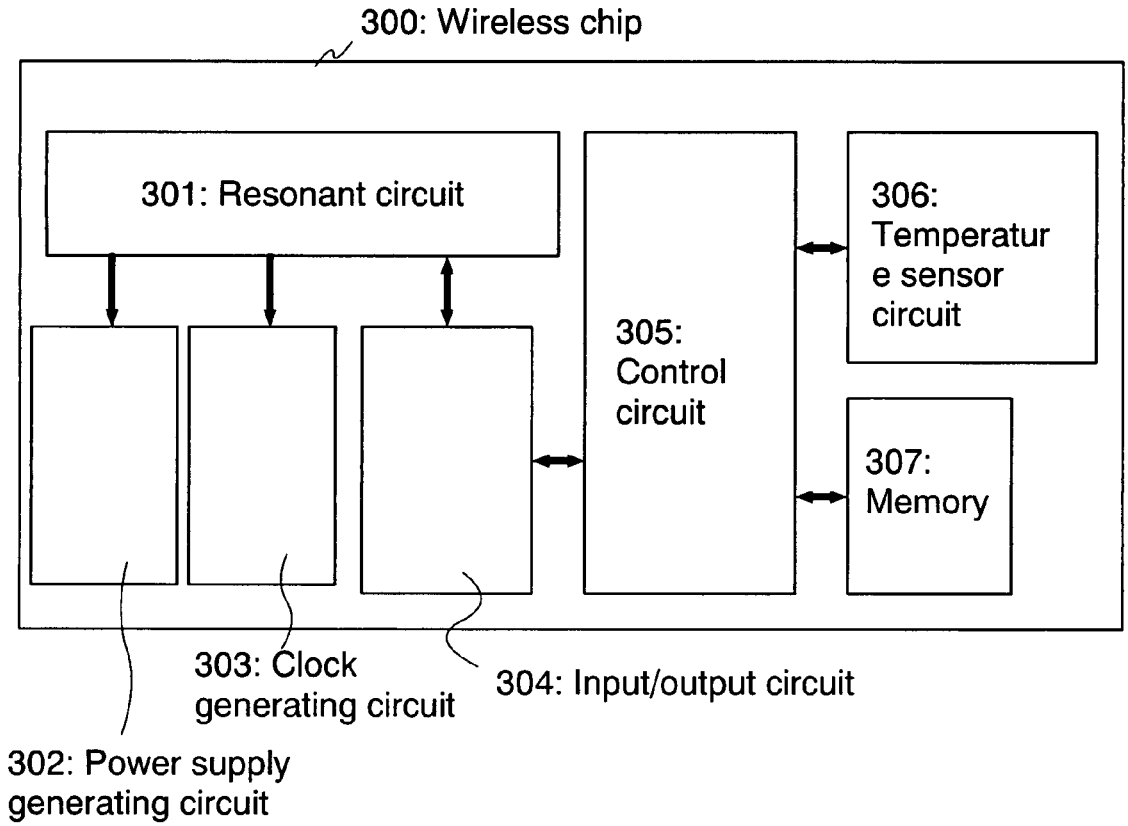
FIG. 2 is a diagram showing internal constitution of a wireless chip of the invention.

FIG. 2 shows internal constitution of the wireless chip. A wireless chip 300 includes a resonant circuit 301 having an antenna and a resonant capacitor, a power supply generating circuit 302, a clock generating circuit 303, an input/output circuit 304, a control circuit 305, a temperature sensor circuit 306, and a memory 307. The power supply generating circuit 302 is a circuit capable of generating a power source from radio waves received through the antenna, to operate a circuit within the wireless chip. The clock generating circuit 303 is a circuit capable of generating a clock from the radio waves received through the antenna, to synchronously operate the circuit within the wireless chip. The input/output circuit 304 is a circuit capable of extracting an instruction from the radio waves received through the antenna and sending data recorded in the memory 307 as a radio wave. The control circuit 305 is a circuit capable of executing the instruction in accordance with the instruction extracted by the input/output circuit 304, so that by the instruction, an installation place of the wireless chip can be recorded in the memory 307 and temperature data obtained from the temperature sensor circuit 306 can be recorded in the memory 307. The temperature sensor circuit 306 is a circuit capable of sensing a temperature by the instruction from the control circuit 305 and sending the temperature data to the control circuit 305.

The memory 307 has a nonvolatile memory incapable of being rewritten in which an individual identification number of a wireless chip is recorded at the manufacturing step of the wireless chip. As such a nonvolatile memory, there is a mask ROM. In addition, the memory 307 has a nonvolatile memory having a structure capable of being written only once and incapable of being erased (hereinafter, called a "write-once memory"), in order to record positional data indicating the installation site of the wireless chip. Such initial data indicating the installation place of the wireless chip does not require to be deleted as long as the wireless chip is moved; therefore, it is preferably recorded in a nonvolatile memory incapable of being rewritten and capable of being additionally written such as a write-once memory. The memory 307 further has a nonvolatile memory capable of being rewritten, in order to record temperature data. As the nonvolatile memory capable of being rewritten, there is an EEPROM (Electrically Erasable Programmable Read Only Memory). If the memory capacitance is enough for this system, write-once memories may be used as the memory for recording the individual identification number of the wireless chip and the memory for recording the positional data indicating the installation site of the wireless chip respectively. In the case where the write-once memory is used as the memory for recording the individual identification number of the wireless chip, the individual identification number of the wireless chip is preferably recorded in the write-once memory before shipment of the wireless chip.

Figure 3:
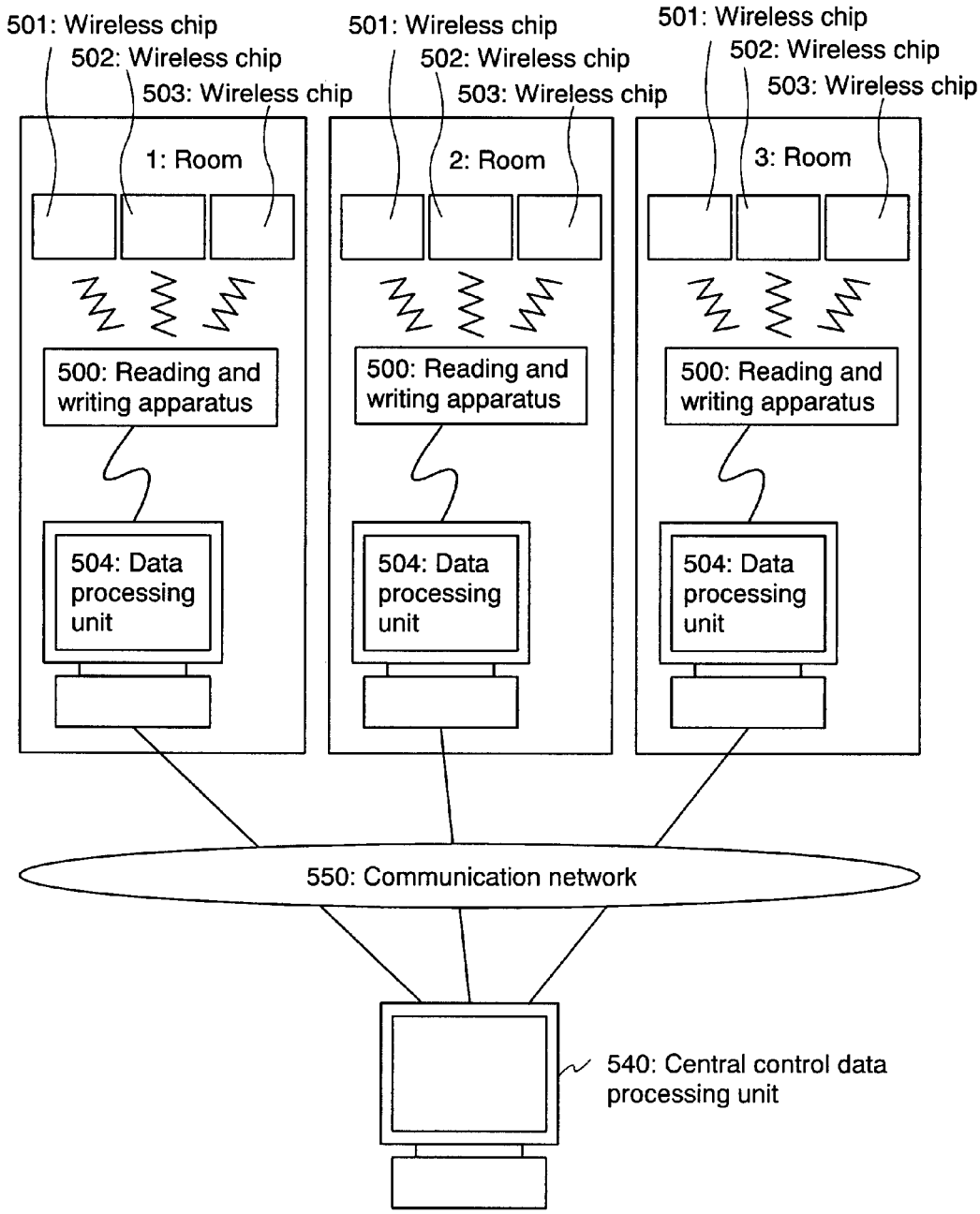
FIG. 3 is a diagram showing a system of the invention.

FIG. 3 shows a summary of the system of the invention. Each of wireless chips 501 to 503 has the constitution of the wireless chip shown in FIG. 2. A reading and writing apparatus 500 sends a radio wave first to a wireless chip so that positional data indicating the installation site is stored, after the wireless chip is attached to a building. The radio wave by which the positional data indicating the installation site is stored includes data indicating the positional data and an instruction for recording the data indicating the positional data in the memory.

After that, the reading and writing apparatus 500 sends a radio wave in order to obtain up-to-date temperature data, to each wireless chip at a certain interval of time. At this time, previous temperature data may be erased. This is because previous temperature data is not required according to this system. Such radio wave for erasing previous temperature data and obtaining up-to-date temperature data includes an instruction for erasing the temperature data recorded before from the memory and an instruction for obtaining up-to-date temperature data from the temperature sensor and recording the data in the memory. The radio wave further includes an instruction for taking out the positional data of the wireless chip and the temperature data from the memory and sending. In addition, the reading and writing apparatus 500 has an interface capable of transferring data to and from a data processing unit 504, so that the positional data or the temperature data sent from the wireless chip can be sent to the data processing unit 504.

In the data processing unit 504, installed is a program for calculating the positional data or the temperature data sent from the reading and writing apparatus to check the temperature of each room. Further, in the data processing unit 504, installed is a program for informing the fire occurrence to a central control data processing unit 540 through a communication network 550 inside the building when the temperature of the room reaches a temperature at which fire occurrence can be judged.

The central control data processing unit 540 is connected to the data processing units 504 through the communication network 550 inside the building and can confirm fire occurrence from each data processing unit 504. In addition, installed is a program for informing to an appropriate contact address, for example, an administrator of the building, through the Internet or the like when the fire occurrence is confirmed.

The central control data processing unit 540 is not necessarily provided within the system; the program for informing to an appropriate contact address through the Internet or the like may be installed in one of the data processing units 504, which may substitute for the central control data processing unit. Alternatively, it may be set that the data processing unit which is close to the wireless chip detecting abnormality of the temperature, close to the fire occurrence informs to an appropriate contact address through the Internet or the like.

Further, in the case where there is only one reading and writing apparatus 500 inside the building, the communication network is not necessarily provided inside the building. For example, program for informing to an appropriate contact address through the Internet or the like may be installed in the data processing unit 504 connected to the reading and writing apparatus 500.

Further, in the reading and writing apparatus, a function capable of installing a program for calculating positional data or temperature data sent from the wireless chip to confirm the temperature of each room and a function capable of installing a program for informing fire occurrence to the central control data processing unit 540 through the communication network 550 inside the building when the temperature of the room reaches a temperature at which the fire occurrence can be judged may be provided, so that the reading and writing apparatus may communicate to the central control data processing unit 540 through the communication network 550 inside the building.

Figure 4:
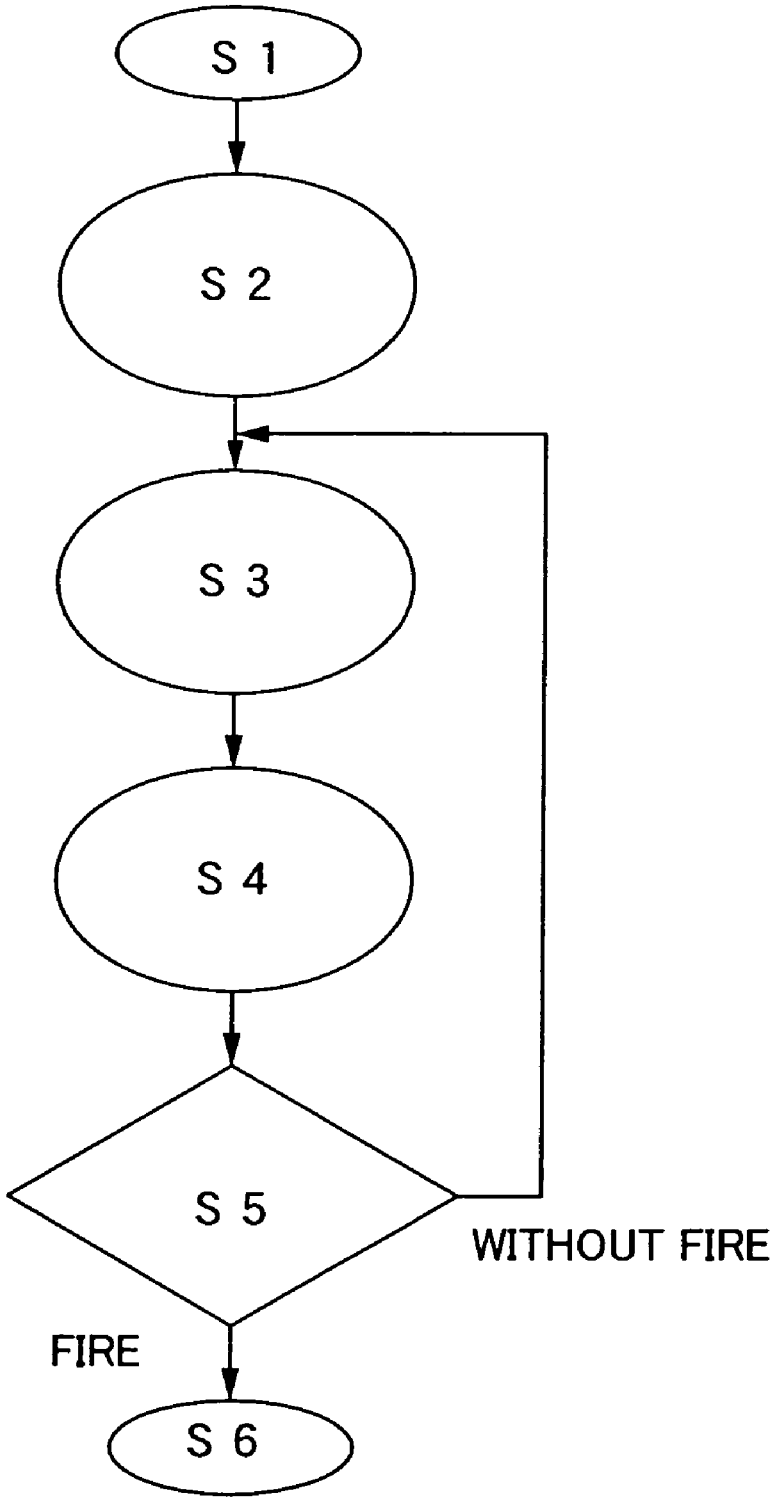
FIG. 4 is a diagram showing a flow chart of a system of the invention.

A series of operations of the system of the invention is described below using a flow chart shown in FIG. 4. A state "START" denoted by S1 means that the wireless chip is attached to a building.

A state "INITIAL DATA INPUT" denoted by S2 means that positional data of the wireless chip is recorded in a memory after the wireless chip is attached to the building. After being attached to the building, the wireless chip which has received a radio wave from the reading and writing apparatus generates a power source from the radio wave and starts an operation. In accordance with the instruction included in the radio wave, the positional data is recorded in the memory using a write-once memory.

A state "TEMPERATURE DATA RECORD" denoted by S3 means that the radio wave is received from the reading and writing apparatus, the temperature data is obtained from the temperature sensor, and the temperature data is recorded in the memory. The wireless chip which has received the radio wave from the reading and writing apparatus generates a power source from the radio wave and starts an operation. In accordance with the instruction included in the radio wave, the temperature data previously recorded is erased from the memory using an EEPROM, and up-to-date temperature data is obtained from the temperature sensor and recorded in the memory using the EEPROM. The previously recorded temperature data means any of the previously recorded data. Thus, the most recently recorded data is not necessarily deleted and deletion may be performed in order from the oldest data.

A state "TEMPERATURE DATA OBTAIN" denoted by S4 means that after the temperature data is recorded in the memory, the positional data of the wireless chip and the temperature data obtained from the temperature sensor are taken out from the memory. Following the state of S3, the wireless chip takes out the individual identification number of the wireless chip from the memory using a ROM, the position date of the wireless chip from the memory using the write-once memory, and the temperature data from the memory using the EEPROM, in accordance with the instruction included in the radio wave, to transmit as a radio wave.

A state "TEMPERATURE DATA JUDGE" denoted by S5 means that the data processing unit judges whether a fire occurs or not based on the individual identification number of the wireless chip, the positional data of the wireless chip, and the temperature data which are obtained from the wireless chip. The reading and writing apparatus receives the positional data and the temperature data from each wireless chip by sending a radio wave, and transmits the obtained positional data and temperature data to the data processing unit. The data processing unit checks the temperature of each room after the positional data and temperature data are transmitted from the reading and writing apparatus, and judges whether a fire occurs or not. If the fire does not occur, the state returns to the state of S3.

The reading and writing apparatus receives the positional data and the temperature data from each wireless chip at a time of sending a radio wave, and transmits the obtained positional data and temperature data to the data processing unit. The data processing unit checks the temperature of each room at a time of being transmitted the positional data and temperature data from the reading and writing apparatus, and judges whether a fire occurs or not.

A state "INFORM" denoted by S6 means the case where the fire occurs. In the case where the fire occurs, the room temperature increases, therefore, the temperature sensed by the temperature sensor included in the wireless chip increases. When the wireless chip receives the radio wave from the reading and writing apparatus, the wireless chip records a value indicating the temperature increase in the memory using the EEPROM. Furthermore, the wireless chip transmits the value indicating the temperature increase as temperature data, in addition to the positional data of the wireless chip, to the reading and writing apparatus. The reading and writing apparatus transmits the received positional data and temperature data to the data processing unit. The data processing unit checks the room in which the temperature increases, at a time of being transmitted the positional data and temperature data from the reading and writing apparatus, and when the temperature of the room reaches a temperature at which fire occurrence can be judged, the data processing unit informs the fire occurrence to the central control data processing unit through the communication network inside the building. The central control data processing unit which has received the information of the fire occurrence informs the fire occurrence to an appropriate contact address through the Internet or the like.

As set forth above, by using the wireless chip incorporating the temperature sensor, a fire sensing system can be easily established in a building or vehicle without restricting the design of the building or vehicle and while suppressing increase of the design cost of the building or vehicle.

Note that in this embodiment mode, the reading and writing apparatus corresponds to a reader and writer and the data processing unit or the central control data processing unit corresponds to a computer.

EMBODIMENT MODE 2

In this embodiment mode, described is a mode of a wireless chip provided with a temperature sensor.

Figure 5:
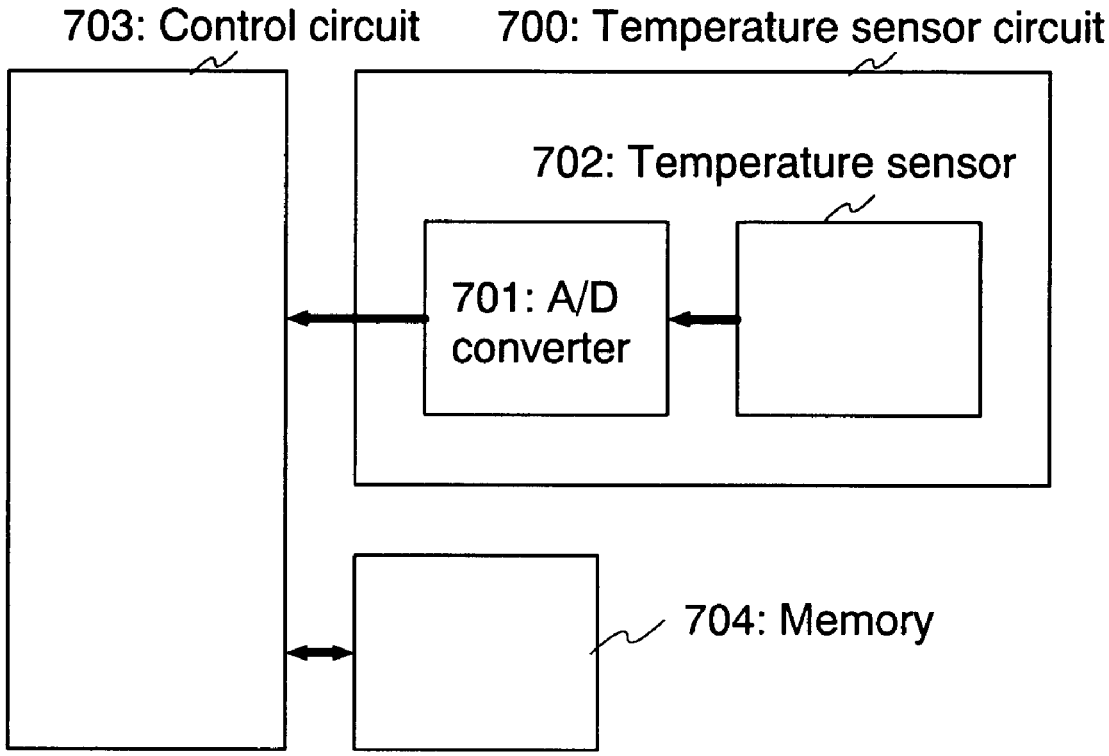
FIG. 5 is a diagram showing a temperature sensor circuit of the invention.

FIG. 5 shows a mode of a wireless chip provided with a temperature sensor in which a temperature sensor circuit 700, a memory 704, and a control circuit 703 are included. The temperature sensor circuit 700 includes an A/D converter 701 and a temperature sensor 702. In such temperature sensor circuit 700, an output of the temperature sensor 702 is inputted to the A/D converter 701. By the control circuit 703, data which is converted into a digital signal through the A/D converter 701 is read from the temperature sensor 702 and recorded to the memory 704.

As a typical mode thereof, there can be a mode in which a temperature sensor is attached to a chip. There can be considered a structure in which the temperature sensor outputs an analog potential and the analog potential is converted into a digital signal by an A/D converter provided inside the chip. Of course, the A/D converter may be provided in the temperature sensor instead of inside the chip as well. In recent years, various compact temperature sensors have been developed, and by providing externally such a temperature sensor, a wireless chip provided with a compact temperature sensor can be realized. For example, a thermistor (resistive element of which resistance varies depending on temperature) or an IC temperature sensor (which uses a temperature characteristics of a base-emitter voltage of an NPN transistor) can be used.

Figure 6:
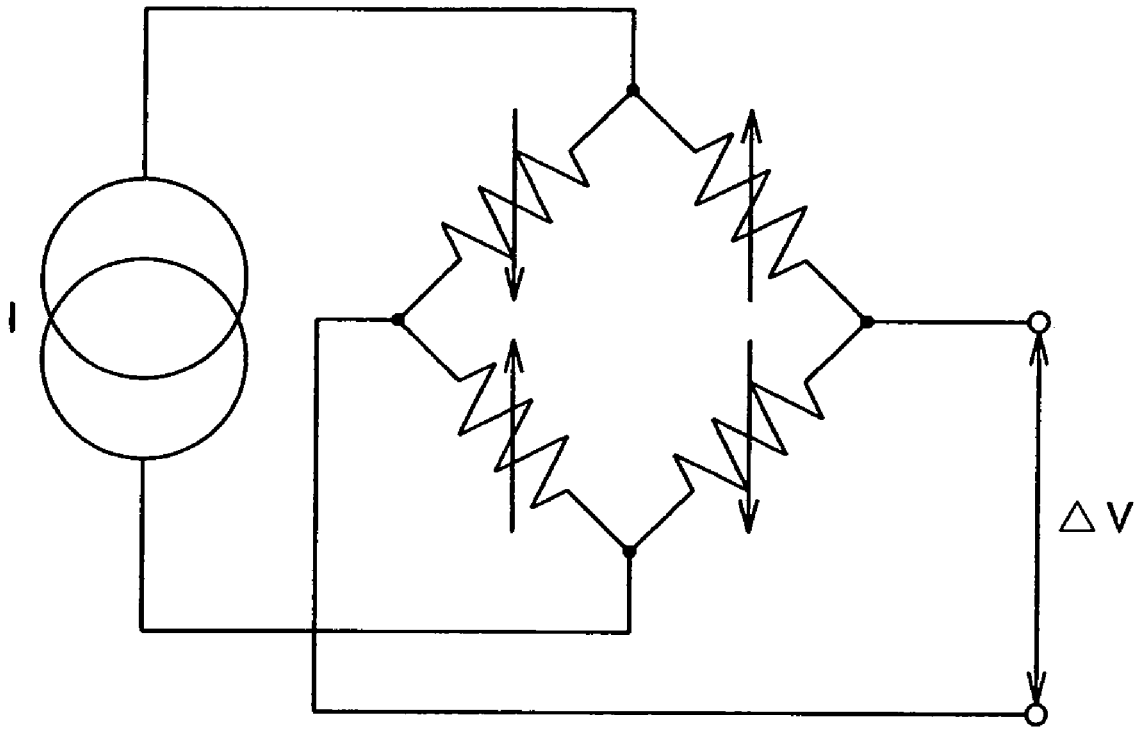
FIG. 6 is a diagram showing a temperature sensor of the invention.

Further, as another typical mode, there can be a mode in which a temperature sensor is formed integrally with a wireless chip, which is the most suitable mode in the invention. As a constitution example of such a temperature sensor, a resistive element of which resistance varies depending on temperature is used and a bridge circuit (FIG. 6) is formed, so that the resistance can be outputted by being converted into change of an analog potential. In addition, as is used in a thermistor, for example, a resistive element of which resistance varies depending on temperature may be used to constitute a temperature sensor as well.

Figure 7:
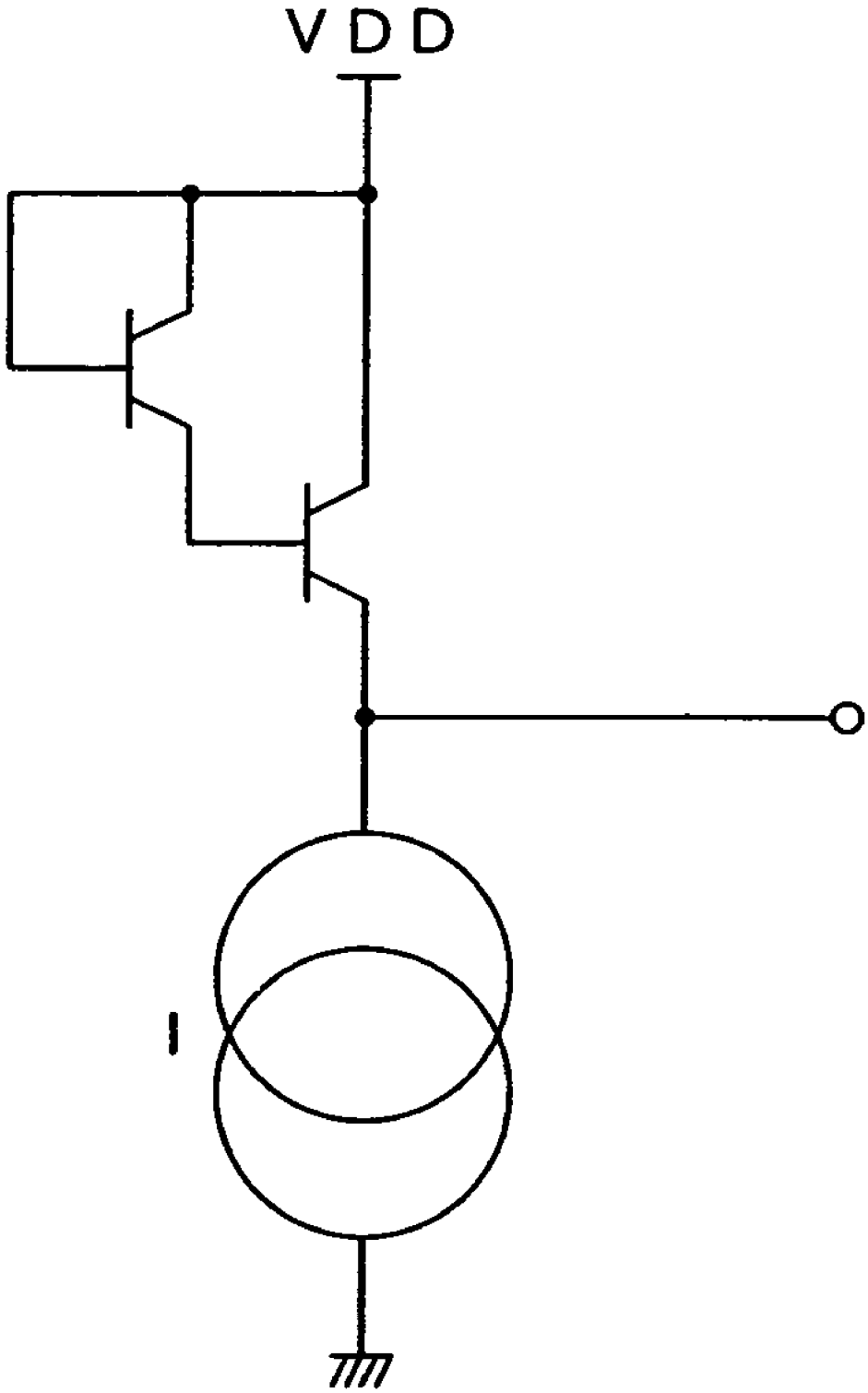
FIG. 7 is a diagram showing a temperature sensor of the invention.

As another mode in which a temperature sensor is formed integrally with a wireless chip, a temperature sensor of outputting a base-emitter voltage can be constituted by an NPN transistor or a Darlington connection thereof (FIG. 7).

In the system of the invention, the wireless chip provided with a sensor in the mode as described above can be used.

EMBODIMENT MODE 3

In this embodiment mode, described is a memory using a write-once memory which is included in a wireless chip, and an operating method thereof. Note that a device using a semiconductor element such as the wireless chip of the invention can be called a semiconductor device.

Figure 8:
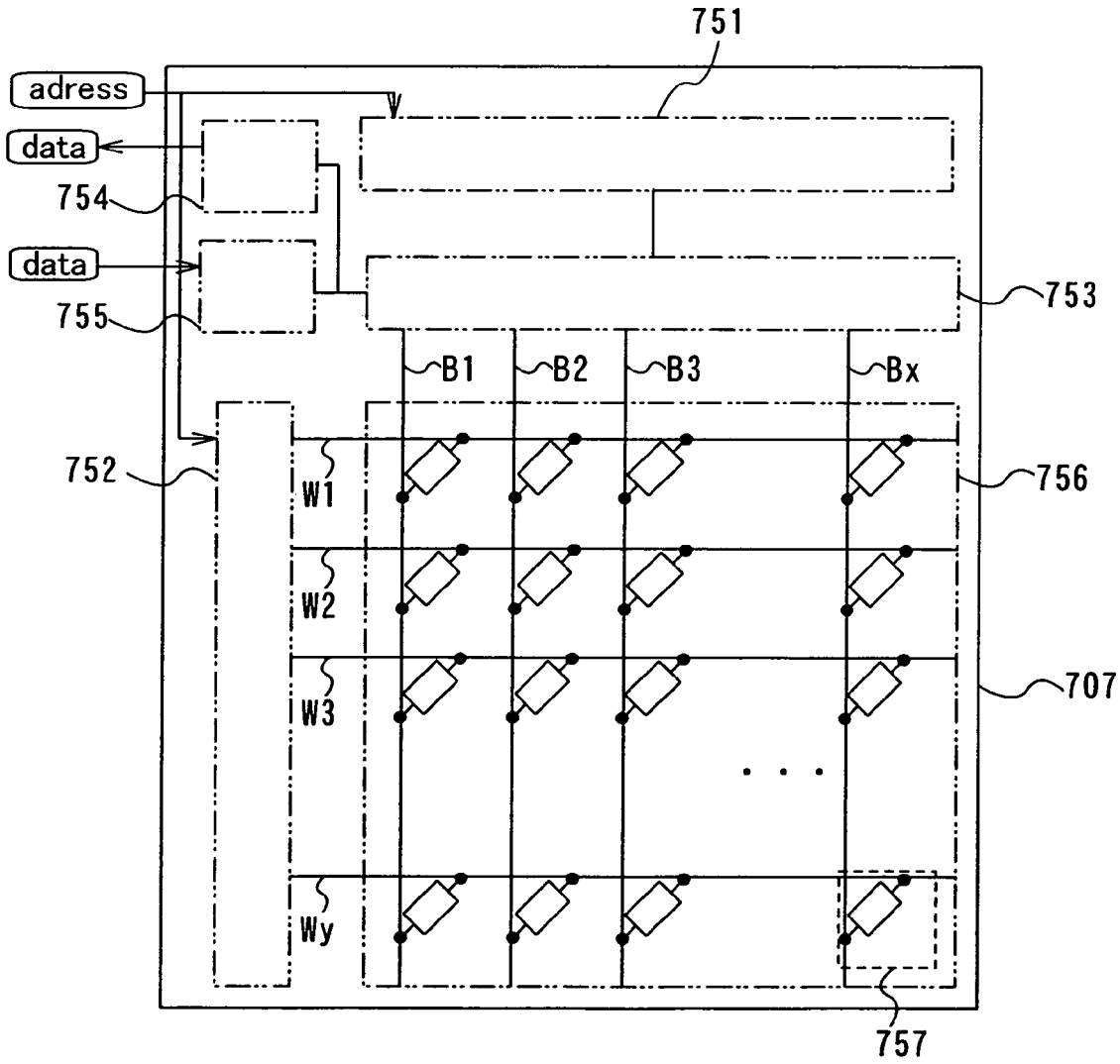
FIG. 8 is a diagram showing a memory of the invention.

As shown in FIG. 8, the memory includes a memory cell array 756 in which memory elements are formed and a driver circuit. The driver circuit includes a column decoder 751, a row decoder 752, a reading circuit 754, a writing circuit 755, and a selector 753.

The memory cell array 756 includes a bit line Bm (m=1 to x), a word line Wn (n=1 to y), and a memory cell 757 each at an intersection between the bit line and the word line.

Note that the memory cell 757 may be either an active type in which a transistor is connected or a passive type which is constituted only by a passive element. In addition, the bit line Bm is controlled by the selector 753 and the word line Wn is controlled by the row decoder 752.

The column decoder 751 receives an address signal for specifying an arbitrary bit line and supplies a signal to the selector 753. The selector 753 receives the signal of the column decoder 751 to select the specified bit line. The row decoder 752 receives an address signal for specifying an arbitrary word line to select the specified word line. According to the above operation, one memory cell 757 corresponding to the address signal is selected. The reading circuit 754 reads data included in the selected memory cell and outputs it. The writing circuit 755 generates a voltage required for writing to apply to the selected memory cell, thereby data writing is performed.

The invention can provide a fire sensing system in which a semiconductor device including the memory using a write-once memory is disposed in a building or vehicle, and a method thereof.

Next, a circuit configuration of the memory cell 757 is described. In this embodiment mode, description is made on a memory cell including a memory element 783 in which an upper electrode and a lower electrode are provided and a memory material layer is interposed between the pair of electrodes.

Figure 9A:
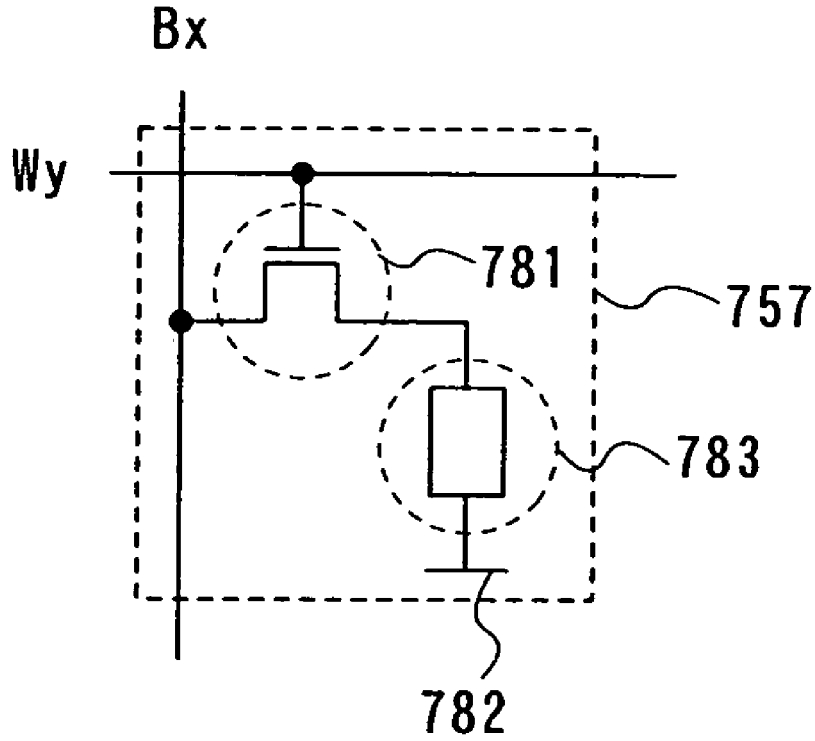
FIGS. 9A and 9B are diagrams each showing a memory element of the invention.

The memory cell 757 shown in FIG. 9A is an active memory cell including a transistor 781 and the memory element 783. To the transistor 781, a thin film transistor can be applied. A gate electrode of the transistor 781 is connected to a word line Wy. In addition, one of a source electrode and a drain electrode of the transistor 781 is connected to a bit line Bx while the other thereof is connected to the memory element 783. The lower electrode of the memory element 783 is electrically connected to the one of the source electrode and the drain electrode of the transistor 781. In addition, the upper electrode (corresponds to a reference numeral 782) of the memory element 783 can be shared between the memory elements, as a common electrode.

Figure 9B:
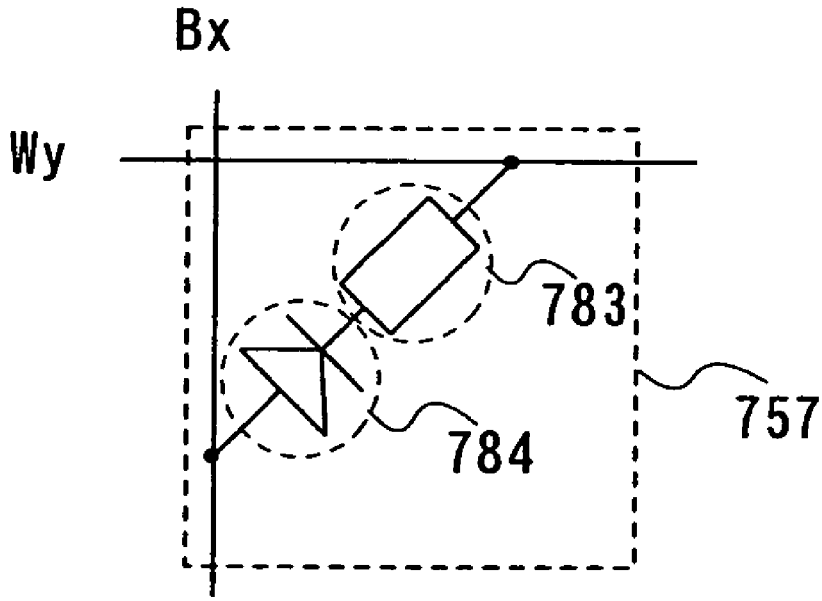

In addition, a configuration as shown in FIG. 9B in which the memory element 783 is connected to a diode 784 may be used as well. The diode 784 can adopt a so-called diode connection structure in which one of a source electrode and a drain electrode of a transistor is connected to a gate electrode thereof. Further, as the diode 784, a Schottky diode which uses contact between a memory material layer and a lower electrode may be also used, or a diode formed by a stacked layer of a memory material may also be used.

For the memory material layer, a material of which property or state changes by electrical action, optical action, thermal action, or the like can be used. For example, a material of which property or state changes by dissolution, dielectric breakdown or the like due to Joule heat so that the upper electrode and the lower electrode can be short-circuited, may be used. Thus, the thickness of the memory material layer may be 5 to 100 nm, and preferably 10 to 60 nm. For such a memory material layer, an inorganic material or an organic material can be used and it can be formed by an evaporation method, a spin-coating method, a droplet discharging method, or the like.

As the inorganic material, there are silicon oxide, silicon nitride, silicon oxynitride, or the like. Even in the case of such an inorganic material, a dielectric breakdown is caused by controlling a film thickness thereof, so that the upper electrode and the lower electrode can be short-circuited.

As the organic material, for example, an aromatic amine based (in other words, including a benzene ring-nitrogen bond) compound such as 4,4'-bis[N-(1-naphthyl)-N-phenylamino]biphenyl (abbreviated: α-NPD), 4,4'-bis[N-(3-methylphenyl)-N-phenylamino]biphenyl (abbreviated: TPD), 4,4'4"-tris(N,N-diphenylamino)triphenylamine (abbreviated: TDATA), 4,4'4"-tris[N-(3-methylphenyl)-N-phenylamino]triphenylamine (abbreviated: MTDATA), and 4,4'-bis[N-{4-(N,N-di-m-tolylamino)phenyl}-N-phenylamino] biphenyl (abbreviated: DNTPD); polyvinylcarbazole (abbreviated: PVK); phthalocyanine (abbreviated: $H_2Pc$); or a phthalocyanine compound such as copper phthalocyanine (abbreviated: CuPc) or vanadyl phthalocyanine (abbreviated: VOPc) can be used. These materials have high hole transporting properties.

In addition, as the organic material, for example, a material formed from a metal complex or the like having a quinoline skeleton or a benzoquinoline skeleton, such as tris(8-quinolinolato)aluminum (abbreviated: $Alq_3$), tris(4-methyl-8-quinolinolato)aluminum (abbreviated: $Almq_3$), bis (10-hydroxybenzo[h]quinolinato)beryllium (abbreviated: $BeBq_2$), or bis(2-methyl-8-quinolinolato)(4-phenylphenolato)aluminum (abbreviated: BAlq); or a metal complex having a oxazole-based ligand or a thiazole-based ligand, such as bis [2-(2'-hydroxyphenyl)benzoxazolato]zinc (abbreviated: $Zn(BOX)_2$) or bis[2-(2'-hydroxyphenyl)benzothiazolato]zinc (abbreviated: $Zn(BTZ)_2$), can also be used. These materials have high electron transporting properties.

Furthermore, other than the metal complex, a compound such as 2-(4-biphenylyl)-5-(4-tert-butylphenyl)-1,3,4-oxadiazole (abbreviated: PBD); 1,3-bis[5-(p-tert-buthylphenyl)-1,3,4-oxadiazol-2-yl]benzene (abbreviated: OXD-7); 3-(4-biphenylyl)-5-(4-tert-butylphenyl)-4-phenyl-1,2,4-triazole (abbreviated: TAZ); 3-(4-biphenylyl)-4-(4-ethylphenyl)-5-(4-tert-butylphenyl)-1,2,4-triazole (abbreviated: p-EtTAZ); bathophenanthroline (abbreviated: BPhen); or bathocuproin (abbreviated: BCP) can be used.

In addition, the memory material layer may be formed by a single layer structure or a stacked layer structure. In the case of the stacked layer structure, with the material selected above, the stacked layer structure can be formed. In addition, the above metal material and a light-emitting material may also be stacked. As the light-emitting material, there are 4-(dicyanomethylene)-2-methyl-6-[2-(1,1,7,7-tetramethyljulolidin-9-yl)ethenyl]-4H-pyran (abbreviated: DCJT); 4-dicianomethylene-2-t-butyl-6-(1,1,7,7-tetramethyljulolidin-9-phenyl)-4H-pyran; periflanthene; 2,5-dicyano-1,4-bis(10-methoxy-1,1,7,7-tetramethyljulolidine-9-phenyl)benzene; N,N'-dimethylquinacridone (abbreviated: DMQd); coumarin 6; coumarin 545T; tris(8-quinolinolato)aluminum (abbreviated: $Alq_3$); 9,9'-bianthryl; 9,10-diphenylanthracene (abbreviated: DPA); 9,10-di(2-naphthyl)anthracene (abbreviated: DNA); 2,5,8,11-tetra(tert-butyl)perylene (abbreviated: TBP), or the like.

Further, a layer in which the above light-emitting material is dispersed may also be used. In the layer in which the above light-emitting material is dispersed, as a mother material, an anthracene derivative such as 9,10-di(2-naphthyl)-2-tert-butylanthracene (abbreviated: t-BuDNA); a carbazole derivative such as 4,4'-di(N-carbazolyl)biphenyl (abbreviated: CBP); a metal complex such as bis[2-(2'-hydroxyphenyl)pyridinato]zinc (abbreviated: $Znpp_2$) or bis [2-(2'-hydroxyphenyl)benzoxazolato]zinc (abbreviated: ZnBOX); or the like can be used. In addition, tris(8-quinolinolato)aluminum (abbreviated: $Alq_3$); 9,10-di(2-naphthyl)

anthracene (abbreviated: DNA); bis(2-methyl-8-quinolinolato)(4-phenylphenolato)aluminum (abbreviated: BAlq); or the like can be used.

The glass-transition temperature (Tg) of such an organic material may be 50 to 300° C., and preferably 80 to 120° C. in order to change its property by thermal action, or the like.

In addition, a material in which a metal oxide is mixed with the above organic material or light-emitting material may also be used. Note that the material mixed with a metal oxide includes a state in which the above organic material or light-emitting material and the metal oxide are mixed or a state in which they are stacked. Specifically, it indicates a state which is formed by a co-evaporation method using multiple evaporation sources. Such a material can be called an organic-inorganic composite material.

For example, in a case of mixing a material having a high hole transporting property with a metal oxide, a vanadium oxide, a molybdenum oxide, a niobium oxide, a rhenium oxide, a tungsten oxide, a ruthenium oxide, a titanium oxide, a chromium oxide, a zirconium oxide, a hafnium oxide, or a tantalum oxide is preferably used as the metal oxide.

In a case of mixing a material having a high electron transporting property with a metal oxide, a lithium oxide, a calcium oxide, a sodium oxide, a kalium oxide or a magnesium oxide is preferably used as the metal oxide.

Also, for the memory material layer, since a material of which property or state changes by electrical action, optical action, thermal action, or the like may be used; a conjugated polymer in which a compound (photoacid generator) generating acidum by absorbing light is added, can also be used, for example. As the conjugated polymer, one kind of polyacetylene, one kind of polyphenylenevinylene, one kind of polythiophene, one kind of polyaniline, one kind of polyphenyleneetylene, or the like can be used. In addition, as the photoacid generator, arylsulfonium salt, aryliodonium salt, o-nitrobenzyltosylate, arylsulfonic acid-p-nitrobenzylester, one kind of sulfonylacetophenone, Fe-arene complex PF6 salt, or the like can be used.

Next, an operation when data writing is performed to the active memory cell 757 as shown in FIG. 9A is described. Note that in this embodiment mode, a value stored in the memory element with an initial state is '0' and a value stored in the memory element with the property changed by electrical action or the like is '1'. In addition, the resistance is high in the memory element with the initial state and the resistance is low in the memory element after change.

When writing is performed, the bit line Bm of the m-th column and the word line Wn of the n-th row are selected by the column decoder 751, the row decoder 752, and the selector 753, and the transistor 781 included in the memory cell 757 in the m-th column and the n-th row is turned on.

Subsequently, from the writing circuit 755, a predetermined voltage is applied to the bit line Bm of the m-th column for a predetermined period. For this voltage and period to be applied, such condition that the memory element 783 changes from the initial state to the state in which the resistance is low, is employed. The voltage applied to the bit line Bm of the m-th column is transmitted to the lower electrode of the memory element 783 so that a potential difference occurs between the lower electrode and the upper electrode. Therefore, current flows through the memory element 783 and there occurs a change in the state of the memory material layer so that the memory element property is changed. Then, the value stored in the memory element 783 is changed from '0' to '1'.

The writing operation described above is performed in accordance with the control circuit 305.

Figure 10:
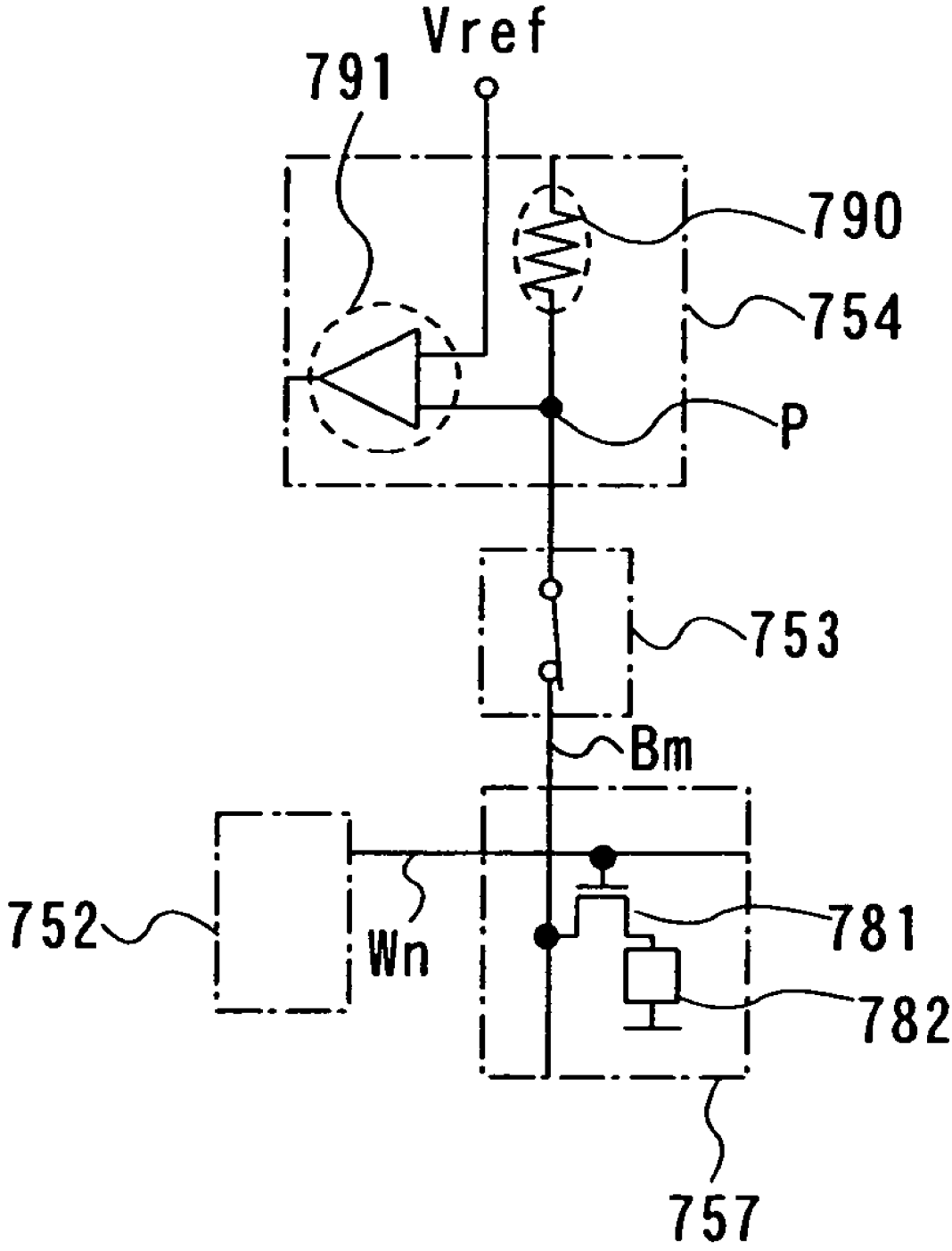
FIG. 10 is a diagram showing a memory element of the invention.

Next, described is an operation of data reading. As shown in FIG. 10, the reading circuit 754 includes a resistor 790 and a sense amplifier 791. For performing the data reading, a voltage is applied between the lower electrode and the upper electrode and whether the memory element is the initial state or the state in which the resistance is low after change is judged. Specifically, data reading can be performed by a resistance-dividing method.

For example, the case of performing data reading of the memory element 783 in the m-th column and the n-th row among a plurality of the memory elements 783 included in the memory cell array 756, is described. First, the bit line Bm of the m-th column and the word line Wn of the n-th row are selected by the column decoder 751, the row decoder 752, and the selector 753. Therefore, the transistor 781 included in the memory cell 757 arranged in the m-th column and the n-th row is turned on so that the memory element 783 and the resistor 790 are connected in series. As a result of this, a potential at a point P shown in FIG. 10 is determined depending on the current characteristic of the memory element 783.

Where the potential of the point P in the case where the memory element is in the initial state is V1 and the potential of the point P in the case where the memory element is in the low-resistance state after change is V2, data stored in the memory element can be read out by using a reference potential Vref which satisfies $V1 \geqq Vref \geqq V2$. Specifically, in the case where the memory element is in the initial state, an output potential of the sense amplifier 791 becomes Lo and in the case where the memory element is in the low-resistance state, the output potential of the sense amplifier 791 becomes Hi.

According to the above-described method, data is read out by a voltage value by using the difference of the resistance and resistance division of the memory element 783; however, the data of the memory element 783 may also be read out by a current value. Note that the reading circuit 754 of the invention is not limited to the above configuration, and may have any configuration as long as data stored in a memory element can be read out.

The memory element having such a configuration changes its state from '0' to '1'. The change from the '0' state to the '1' state is irreversible, therefore, the memory element is a write-once memory.

Initial data can be written to such a memory element 783, and besides, data from the temperature sensor circuit can be written sequentially. Then, the written data can be read out by wireless communication.

Note that this embodiment mode can be implemented freely combining with the above-described embodiment modes.

EMBODIMENT MODE 4

In this embodiment mode, a cross sectional diagram of a memory is described.

Figure 11A:
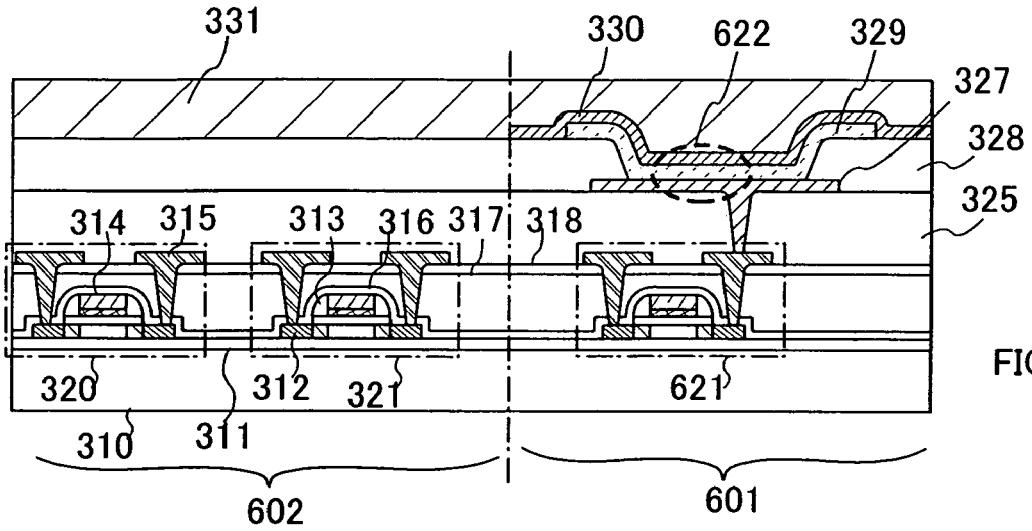
FIGS. 11A and 11B are diagrams each showing a cross section of a memory of the invention.

FIG. 11A is a cross sectional diagram of a memory element in which a memory cell portion 601 and a driver circuit portion 602 are integrally formed over an insulating substrate 310. As the insulating substrate 310, a glass substrate, a quartz substrate, a substrate formed of silicon, a metal substrate, or the like can be used.

A base film 311 is formed over the insulating substrate 310. In the driver circuit portion 602, thin film transistors 320 and 321 are provided through the base film 311, and in the memory cell portion 601, the thin film transistor 781 is provided through the base film 311. Each thin film transistor is provided with a semiconductor film 312 which is patterned into an island-shape, a gate electrode 314 provided through a gate insulating film, and an insulator (namely, a side-wall) 313 provided on side surfaces of the gate electrode. The semiconductor film 312 is formed with a thickness of 0.2 μm or less, typically a thickness of 40 nm or more but 170 nm or less, and preferably a thickness of 50 nm or more but 150 nm or less. Further, an insulating film 316 covering the semiconductor film 312 and an electrode 315 which is connected to an impurity region formed in the semiconductor film 312 are included. Note that the electrode 315 which is connected to the impurity region can be formed by that a contact hole is formed in the gate insulating film and the insulating film 316, a conductive film is formed in the contact hole, and the conductive film is patterned.

In the memory of the invention, the insulating film typified by the gate insulating film can be manufactured using high-density plasma treatment. High-density plasma treatment is such a plasma treatment that the plasma density is $1\times10^{11}$ $cm^{-3}$ or more, and preferably $1\times10^{11}$ $cm^{-3}$ or more but $9\times10^{15}$ $cm^{-3}$ or less, and a high frequency wave such as a microwave (for example, a frequency of 2.45 GHz) is used. In the case where plasma is generated with such a condition, the electron temperature becomes about 0.2 eV or more but 2 eV or less. The high-density plasma having a feature of a low electron temperature has a low kinetic energy of an activated species, therefore, a film can be formed without having plasma damage and a defect so much. For example, in a case where an insulating film is formed over an object to be processed, a substrate over which a patterned semiconductor film is formed is disposed as the object to be processed in a film formation chamber capable of such plasma treatment. Then, the distance between an electrode for generating plasma, namely an antenna and the object to be processed is set to be 20 mm or longer but 80 mm or shorter, and preferably 20 mm or longer but 60 mm or shorter to perform the film formation treatment. Such high-density plasma treatment enables low temperature process (a substrate temperature of 400° C. or less) to be achieved. Therefore, plastic of which heat resistance is low can be used as the substrate.

As a film-formation atmosphere of such an insulating film, a nitrogen atmosphere or an oxygen atmosphere can be used. The nitrogen atmosphere is typically a mixed atmosphere of nitrogen and a rare gas or a mixed atmosphere of nitrogen, hydrogen and a rare gas. As the rare gas, at least one of helium, neon, argon, krypton, and xenon can be used. The oxygen atmosphere is typically a mixed atmosphere of oxygen and a rare gas, a mixed atmosphere of oxygen, hydrogen, and a rare gas, or a mixed atmosphere of dinitrogen monoxide and a rare gas. As the rare gas, at least one of helium, neon, argon, krypton, and xenon can be used.

The insulating film thus formed does not so damage another coating film and can be dense. In addition, the insulating film formed by the high-density plasma treatment can improve the state of an interface which is in contact with the insulating film. For example, when the gate insulating film is formed using the high-density plasma treatment, the state of the interface with the semiconductor film can be improved. Consequently, the electrical property of a thin film transistor can be improved.

The description is made on the case where the high-density plasma treatment is used for manufacturing the insulating film; however, the high-density plasma treatment may be performed to the semiconductor film as well. By the high-density plasma treatment, property modification of a surface of the semiconductor film can be performed. Consequently, the state of the interface can be improved, and correspondingly, the electrical property of a thin film transistor can be improved.

Furthermore, in order to improve the flatness, insulating films 317 and 318 may be provided. In that case, the insulating film 317 may be formed of an organic material and the insulating film 318 may be formed of an inorganic material. In the case where the insulating films 317 and 318 are provided, the electrode 315 can be formed in these insulating films 317 and 318 so as to be connected to the impurity region through a contact hole.

Further, an insulating film 325 is provided and a lower electrode 327 is formed so as to be connected to the electrode 315. An insulating film 328 is formed provided with an opening so as to cover an end portion of the lower electrode 327 and expose the lower electrode 327. Inside the opening, a memory material layer 329 is formed and an upper electrode 330 is formed. In this manner, the memory element 783 including the lower electrode 327, the memory material layer 329, and the upper electrode 330 can be formed. The memory material layer 329 can be formed of an organic material or an inorganic material. The lower electrode 327 or the upper electrode 330 can be formed of a conductive material. For example, a film made from an element of aluminum (Al), titanium (Ti), molybdenum (Mo), tungsten (W), or silicon (Si) an alloy film using the element can be used. Furthermore, a light-transmitting material such as indium tin oxide (ITO), indium tin oxide containing silicon oxide, or indium oxide containing zinc oxide of 2% or more but 20% or less can also be used.

In order to improve flatness further and prevent an impurity element from entering, an insulating film 331 may be formed.

For the insulating film described in this embodiment mode, an inorganic material or an organic material can be used. As the inorganic material, silicon oxide or silicon nitride can be used. As the organic material, polyimide, acryl, polyamide, polyimidamide, resist or benzocyclobutene, siloxane, or polysilazane can be used. Note that a siloxane resin corresponds to a resin containing an Si—O—Si bond. Siloxane is composed of a skeleton formed by the bond of silicon (Si) and oxygen (O), in which an organic group containing at least hydrogen (such as an alkyl group or aromatic hydrocarbon) is included as a substituent. Alternatively, a fluoro group may be used as the substituent. Polysilazane is formed by using a polymer material having the bond of silicon (Si) and nitrogen (Ni) as a starting material.

Figure 11B:
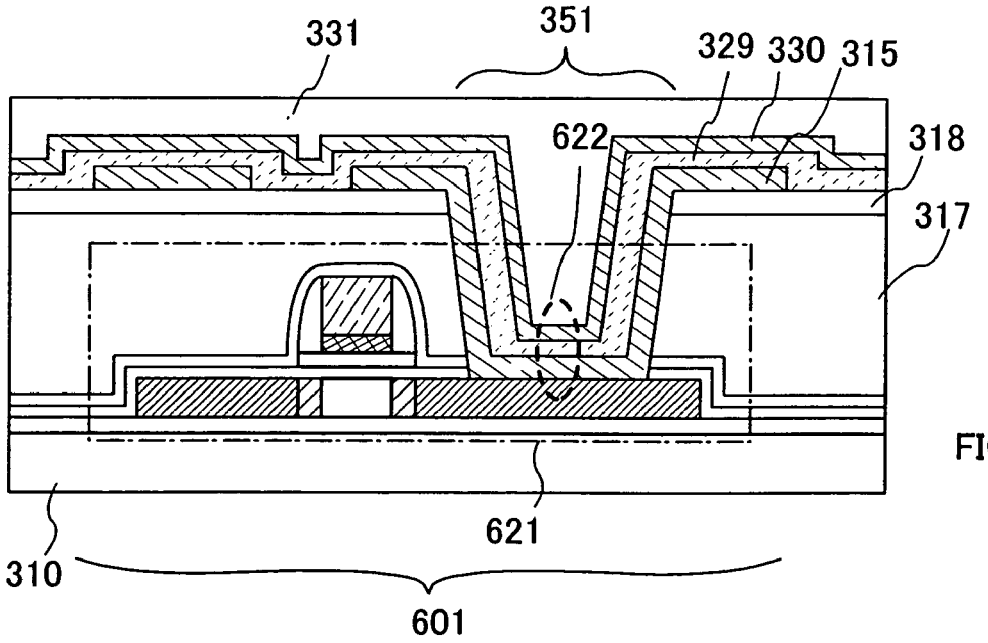

FIG. 11B is a cross sectional diagram of a memory element which is different from FIG. 11A, in which the memory material layer is formed within a contact hole 351 of the electrode 315. Similarly to FIG. 11A, the electrode 315 is used as the lower electrode, and the memory material layer 329 and the upper electrode 330 are formed over the electrode 315 to form the memory element 783. After that, the insulating film 331 is formed. The other configuration is the same as FIG. 11A, thus description thereof is omitted herein.

By forming the memory element in the contact hole 351, miniaturization of a memory can be achieved. Further, since an electrode for a memory is not required, the number of manufacturing steps is reduced and a memory at low cost can be provided.

As set forth above, a memory capable of being applied to the informing method and the system thereof of the invention, is manufactured over an insulating substrate, and a driver circuit can be integrally formed; thereby manufacturing cost can be reduced.

What is claimed is:

1. A fire sensing method comprising:

recording positional data in a memory included in a wireless chip having a power supply generating circuit, the positional data indicating where the wireless chip is attached;

obtaining temperature data from a temperature sensor included in the wireless chip;

judging whether the temperature data reaches a temperature at which a fire occurs or not based on the temperature data of the wireless chip; and informing an appropriate contact address when the temperature data reaches the temperature at which the fire occurs, wherein the wireless chin receives a radio wave including data for indicating the positional data and an instruction for recording the data for indicating the positional data from a reading and writing apparatus.

2. A fire sensing method according to claim 1, wherein the positional data is taken out from the memory by a reading and writing apparatus.

3. A fire sensing method according to claim 1, wherein whether the temperature data reaches the temperature at which the fire occurs or not is judged based on the temperature data by a data processing unit.

4. A fire sensing method according to claim 1, wherein the memory has a structure incapable of being rewritten.

5. A fire sensing method according to claim 1, wherein the radio wave includes an instruction for erasing a temperature data recorded in the memory.

6. A fire sensing method according to claim 1, wherein the memory includes a memory element and a transistor connected to the memory element, and the memory element and the transistor are provided over an insulating substrate.

7. A fire sensing method according to claim 6, wherein the memory element is an element in which a memory material layer is interposed between a pair of electrodes.

8. A fire sensing method comprising:

recording an individual identification number in a memory included in a wireless chip having a power supply generating circuit;

recording positional data in the memory, the positional data indicating where the wireless chip is attached;

obtaining temperature data from a temperature sensor included in the wireless chip;

judging whether the temperature data reaches a temperature at which a fire occurs or not based on the temperature data; and informing an appropriate contact address when the temperature data reaches the temperature at which the fire occurs, wherein the wireless chip receives a radio wave including data for indicating the positional data and an instruction for recording the data for indicating the positional data from a reading and writing apparatus.

9. A fire sensing method according to claim 8, wherein the positional data is taken out from the memory by a reading and writing apparatus.

10. A fire sensing method according to claim 8, wherein whether the temperature data reaches the temperature at which the fire occurs or not is judged based on the temperature data by a data processing unit.

11. A fire sensing method according to claim 8, wherein the memory has a structure incapable of being rewritten.

12. A fire sensing method according to claim 8, wherein the radio wave includes an instruction for erasing a temperature data recorded in the memory.

13. A fire sensing method according to claim 8, wherein the memory includes a memory element and a transistor connected to the memory element, and the memory element and the transistor are provided over an insulating substrate.

14. A fire sensing method according to claim 13, wherein the memory element is an element in which a memory material layer is interposed between a pair of electrodes.

15. A fire sensing system comprising:

a wireless chip having a temperature sensor and a power supply generating circuit;

a reading and writing apparatus for recording positional data in a memory included in the wireless chip, the positional data indicating where the wireless chip is attached;

a data processing unit connected to the reading and writing apparatus; and a central control data processing unit connected through a communication network, wherein temperature data is recorded in the memory from the temperature sensor included in the wireless chip by the reading and writing apparatus; and wherein based on the temperature data of the wireless chip from the memory, whether the temperature data reaches a temperature at which a fire occurs or not is judged by the data processing unit or the central control data processihg unit.

16. A fire sensing system according to claim 15, wherein the memory has a structure incapable of being rewritten.

17. A fire sensing system according to claim 15, wherein the memory includes a memory element and a transistor connected to the memory element, and the memory element and the transistor are provided over an insulating substrate.

18. A fire sensing system according to claim 17, wherein the memory element is an element in which a memory material layer is interposed between a pair of electrodes.

19. A fire sensing system comprising:

a plurality of wireless chips each having a temperature sensor and a power supply generating circuit;

a reading and writing apparatus for recording positional data in a memory included in each of the plurality of wireless chips, the positional data indicating where each of the plurality of wireless chips is attached;

a data processing unit connected to the reading and writing apparatus; and a central control data processing unit connected through a communication network, wherein an identification number of each of the plurality of wireless chips is recognized and temperature data is recorded in the memory from the temperature sensor included in each of the plurality of wireless chips by the reading and writing apparatus; and wherein based on the temperature data of the wireless chip from the memory, whether the temperature data reaches a temperature at which a fire occurs or not is judged by the data processing unit or the central control data processing unit.

20. A fire sensing system according to claim 19, wherein the memory has a structure incapable of being rewritten.

21. A fire sensing system according to claim 19, wherein the memory includes a memory element and a transistor connected to the memory element, and the memory element and the transistor are provided over an insulating substrate.

22. A fire sensing system according to claim 21, wherein the memory element is an element in which a memory material layer is interposed between a pair of electrodes.

* * * * *